US006641489B1

(12) United States Patent
Wright et al.

(10) Patent No.: US 6,641,489 B1
(45) Date of Patent: Nov. 4, 2003

(54) GOLF CLUB SHAFT WITH SUPPRESSED VIBRATION MODES

(75) Inventors: David E. Wright, Glendale, AZ (US); Mustapha Hayouna, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/184,135

(22) Filed: Jun. 26, 2002

Related U.S. Application Data

(62) Division of application No. 09/613,148, filed on Jul. 11, 2000, now Pat. No. 6,431,996.

(51) Int. Cl.[7] ..... A63B 53/10; A63B 53/12

(52) U.S. Cl. ..... 473/318

(58) Field of Search ..... 473/316–323, 473/292, 282, 289, 520, 521, 523, 559, 560, 561, 564, 565, 566, 567

(56) References Cited

U.S. PATENT DOCUMENTS 3,974,012 A * 8/1976 Hogarth ..... 156/161
5,294,119 A 3/1994 Vincent et al.
5,297,791 A 3/1994 Negishi ..... 273/80 R
5,655,975 A 8/1997 Nashif ..... 473/316
5,683,308 A 11/1997 Monette ..... 473/318
5,703,294 A 12/1997 McConnell et al. ..... 73/579
5,759,113 A * 6/1998 Lai et al. ..... 473/321

* cited by examiner

*Primary Examiner*—Stephen Blau
(74) *Attorney, Agent, or Firm*—Darrell F. Marquette; John D. Titus

(57) ABSTRACT

A golf club having suppressed vibration modes is disclosed. The club comprises a shaft, a golf club head, a grip and a plurality of discrete shaft stiffeners. The shaft stiffeners are strategically located along the shaft so as to shift the nodes of at least the second and third flexural vibration modes of the club shaft such that a node of each of the second and third flexural vibration modes occurs both at the club face and within the region underlying the golf club grip. Preferably, the stiffeners are made of a shape memory alloy that can be shrunk onto the outside surface of the shaft, then expanded to permit the position of the stiffeners to be adjusted to suit the boundary conditions imposed by the human user.

8 Claims, 8 Drawing Sheets

GOLF CLUB SHAFT WITH SUPPRESSED VIBRATION MODES

This application is a divisional of application(s) application Ser. No. 09/613,148, now U.S. Pat. No. 6,431,996, filed on Jul. 11, 2000.

BACKGROUND OF THE INVENTION

This invention relates generally to golf clubs and, in particular, to golf club shafts.

Typically, golf clubs include an elongated shaft, a club head attached to the lower end of the shaft, and a grip attached to the upper end of the shaft. It is well known that when a golf club is used to strike the golf ball, the impact between the golf club head and the golf ball causes the golf club shaft to vibrate. When a golfer swings a golf club so that the club head impacts the golf ball at the club head's center of gravity, generally, no unpleasant vibrations are experienced. However, if the club head impacts the golf ball at a location that is offset from the center of gravity, unpleasant vibrations are transmitted through the club head, the shaft and the grip to the golfer's hands. Various methods have been proposed to damp the unpleasant vibrations resulting from such a mis-hit.

U.S. Pat. No. 5,294,119 to Vincente, et al. discloses a vibration damping device for golf clubs that is located on the shaft adjacent the club head or the grip. In one embodiment, the damping device consists of an outer ring made of a rigid material such as metal and an intermediate layer made of a visco-elastic material. The intermediate layer has an inner surface bonded to the outside of the shaft and an outer surface bonded to the inside of the outer ring. In another embodiment, the damping device consists of a rigid cylindrical ring disposed within the hollow golf club shaft. A visco-elastic intermediate layer has its outer surface bonded to the inner surface of the golf club shaft and an inner surface bonded to the outer surface of the rigid ring.

U.S. Pat. No. 5,655,975 to Nashif discloses a vibration damping device consisting of a flexible rod disposed within and extending substantially the entire length of the golf club shaft. The rod is bonded to the inside surface of the golf club shaft by a visco-elastic material interposed between the shaft and the rod. According to the patent, the rod is flexible and has resonant frequencies over the same frequency range as the shaft such that the shaft and rod vibrate out of phase with respect to each other and thereby deform the visco-elastic material thereby damping vibrations in the shaft.

U.S. Pat. No. 5,683,308 to Monet discloses a vibration damping device consisting of a solid shaft disposed inside the golf club shaft extending substantially the entire length of the shaft. The rod is secured to the interior surface of the golf club shaft by means of plural resilient and non-resilient discs interposed between the rod and the interior surface of the golf club shaft. Although these and other vibration damping apparatus mitigate with varying success unpleasant vibrations transmitted by the golf club shaft, they do so only at the expense of energy lost in the form of frictional heat generated in the visco-elastic material, and do not address the basic biomechanical interaction between the mode shapes of the golf club shaft and the human golfer.

U.S. Pat. No. 5,297,971 to Negishi discloses a golf club shaft having a single vibration preventing piece composed of a shape memory alloy clamped to the shaft at a location generally coincident with the kick point (i.e. the antinode of the second mode) of the shaft.

U.S. Pat. No. 5,703,294 to McConnell, et al. addresses the need to evaluate the vibration characteristics of golf clubs with the purpose of improving the feel by selecting a golf club head and shaft combination that produces node lines that intersect to form a triangular region proximal the center of the face of the club. McConnell fails to recognize, however, that a major contributing factor to the feel of a golf club is the modal shape proximal the golf club grip, where the interface between the shaft and golfer occurs.

What is needed is a golf club in which the vibration characteristics of the shaft are tuned to produce nodes of the dominant flexural bending modes proximal both the face of the club and the grip.

SUMMARY OF THE INVENTION

The present invention solves the foregoing need by providing a method of measuring the flexural vibration mode frequencies of a golf club for the purpose of determining optimum placement of a plurality of discrete shaft stiffeners. A golf club constructed in accordance with the principles of the present invention comprises a shaft, a golf club head, a grip and a plurality of discrete shaft stiffeners. The shaft stiffeners are strategically located along the shaft so as to shift the nodes of at least the second and third flexural vibration modes such that a node of each of the second and third flexural vibration modes occurs both at the club face and proximal the golf club grip. Preferably, the stiffeners are located so as to shift the nodes of the second through fifth flexural vibration modes such that a node of each of the second through fifth vibration modes occurs both at the club face and proximal the golf club grip. By suppressing certain vibration modes to cause node lines at both the club face and grip, both accuracy and comfort are increased.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
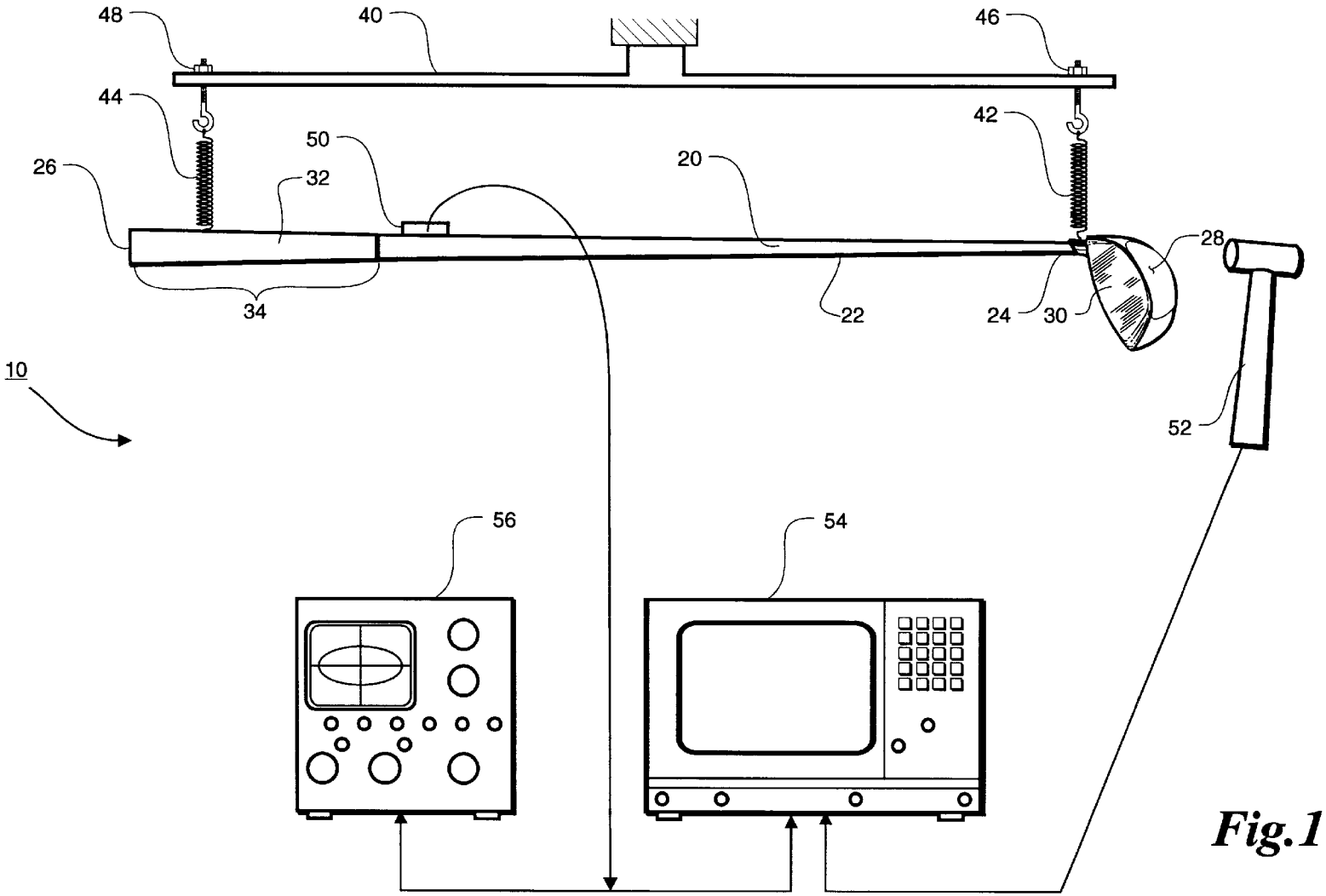
FIG. 1 is a schematic of a measurement system used to measure frequency response and transfer function of a golf club in accordance with the present invention.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

FIG. 1 depicts schematically a measurement system 10 used to take frequency response measurements of a golf club 20. Club 20 comprises a shaft 22 having a tip end 24 and a butt end 26 a golf club head 28 having a face 30 is rigidly attached to shaft 22 by conventional means. Although discontinuities such as tip stiffeners and butt stiffeners may be associated with the inside surface of shaft 22, shaft 22 comprises generally a conical frustum having an inside surface (not shown) that widens progressively from tip end 24 to butt end 26, and an outside surface 36 that widens progressively from tip end 24 to butt end 26. A grip 32 is attached to shaft 22 at butt end 26 and extends toward tip end 24 a predetermined distance, typically about 10 to 12 inches, as determined by the particular grip used. That portion of shaft 22 surrounded by grip 32 is referred to herein as grip region 34.

In order to take frequency response measurements of club 20, club 20 is suspended from a substantially rigid arm 40 by a pair of compliant supports 42 and 44 one each proximal the tip end and the butt end of shaft 22. Compliant supports 42 and 44 may be conventional extension springs or, preferably, a pair of conventional rubber bands. Compliant supports 42 and 44 are coupled to arm 40 by conventional threaded fasteners, shock cords, or other conventional means 46 and 48. The purpose of the compliant support of shaft 22 is to permit both the butt end and the tip end of shaft 22 to vibrate without substantial rigid constraints. Accordingly, any conventional means of suspending a shaft to permit substantially free vibration thereof is suitable for the measurements taken in accordance with the present invention.

A conventional accelerometer 50, such as a PCB ICP model A353B17 sold by Piezotronics, Inc. of Depew, N.Y., is releasably attached to shaft 22 by petroleum wax or other conventional releasable adhesive at a predetermined point on shaft 22. Face 30 of club head 28 is struck several times using a conventional impulse hammer 52, such as a PCB model No. 086C03 with a model 302A07 accelerometer attached thereto. The force input by impulse hammer 52 and the frequency response of accelerometer 50 are fed into a frequency analyzer 54, such as a Hewlett Packard Model 3566A frequency analyzer, which calculates the frequency spectrum of the shaft response and the transfer function associated with the hammer impact. It should be observed that only flexural vibration modes are measured by accelerometer 50, the inventor of the present invention having determined that flexural vibration is more important to club feel than is angular vibration.

After the measurements have been completed with accelerometer 50 in one location along shaft 22, accelerometer 50 is relocated to another position along shaft 22 and the measurements repeated. Typically measurements are taken with accelerometer 50 positioned at one inch increments along the entirety of shaft 22, however, finer or coarser increments may be acceptable depending on the required precision of the particular design.

Figure 2:
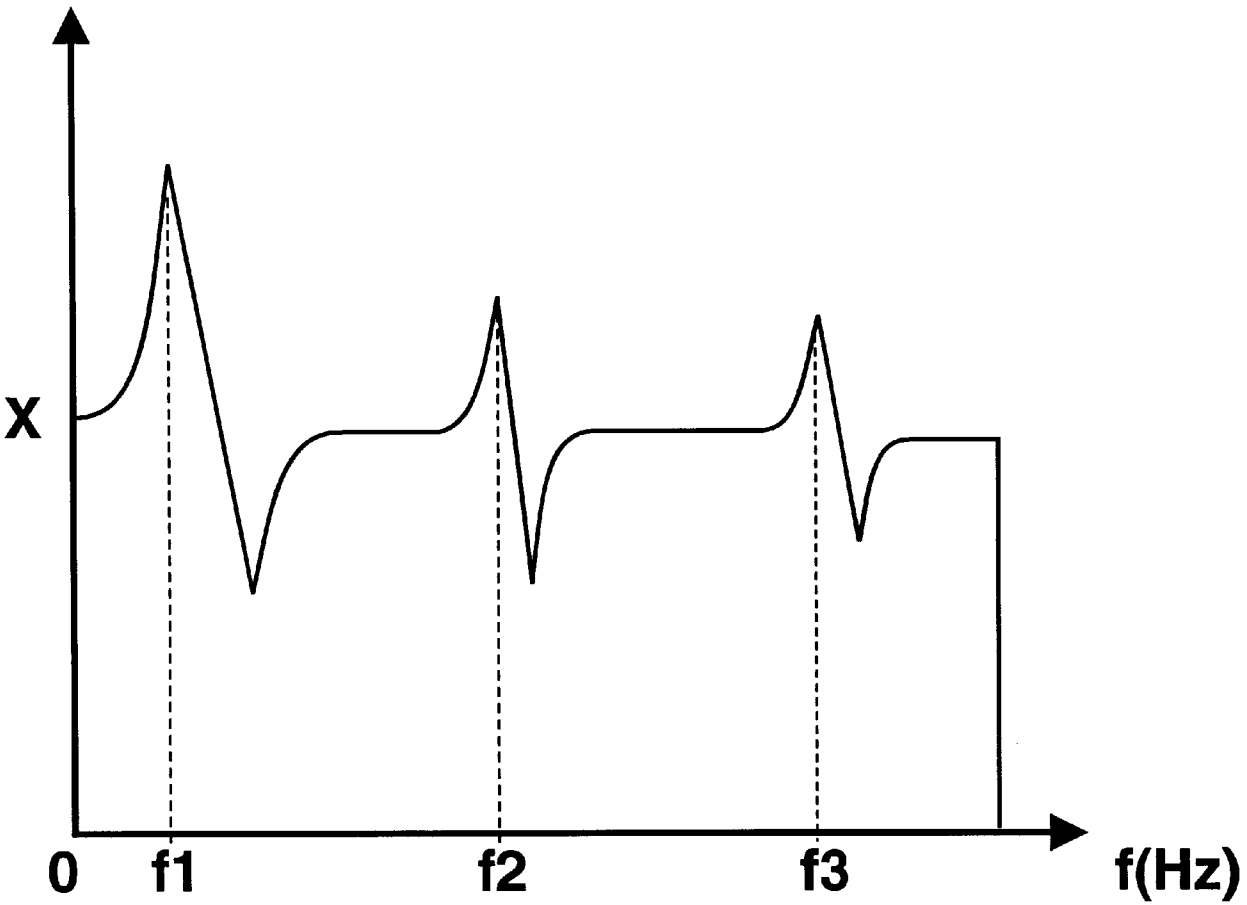
FIG. 2 is a simplified plot of a frequency response measurement.

As shown in FIG. 2, the frequency spectrum data recorded by; the frequency analyzer is used to identify the natural frequencies of flexural vibration. FIG. 2 depicts a simplified frequency plot showing amplitude "y" versus frequency "f(Hz)" (x-axis) for a portion of the data recorded in a typical measurement. The lowest frequency at which the amplitude peaks is the first mode f1, the second lowest frequency at which the amplitude peaks is the second mode f2, the third lowest frequency the third mode, etc.

Figure 3:
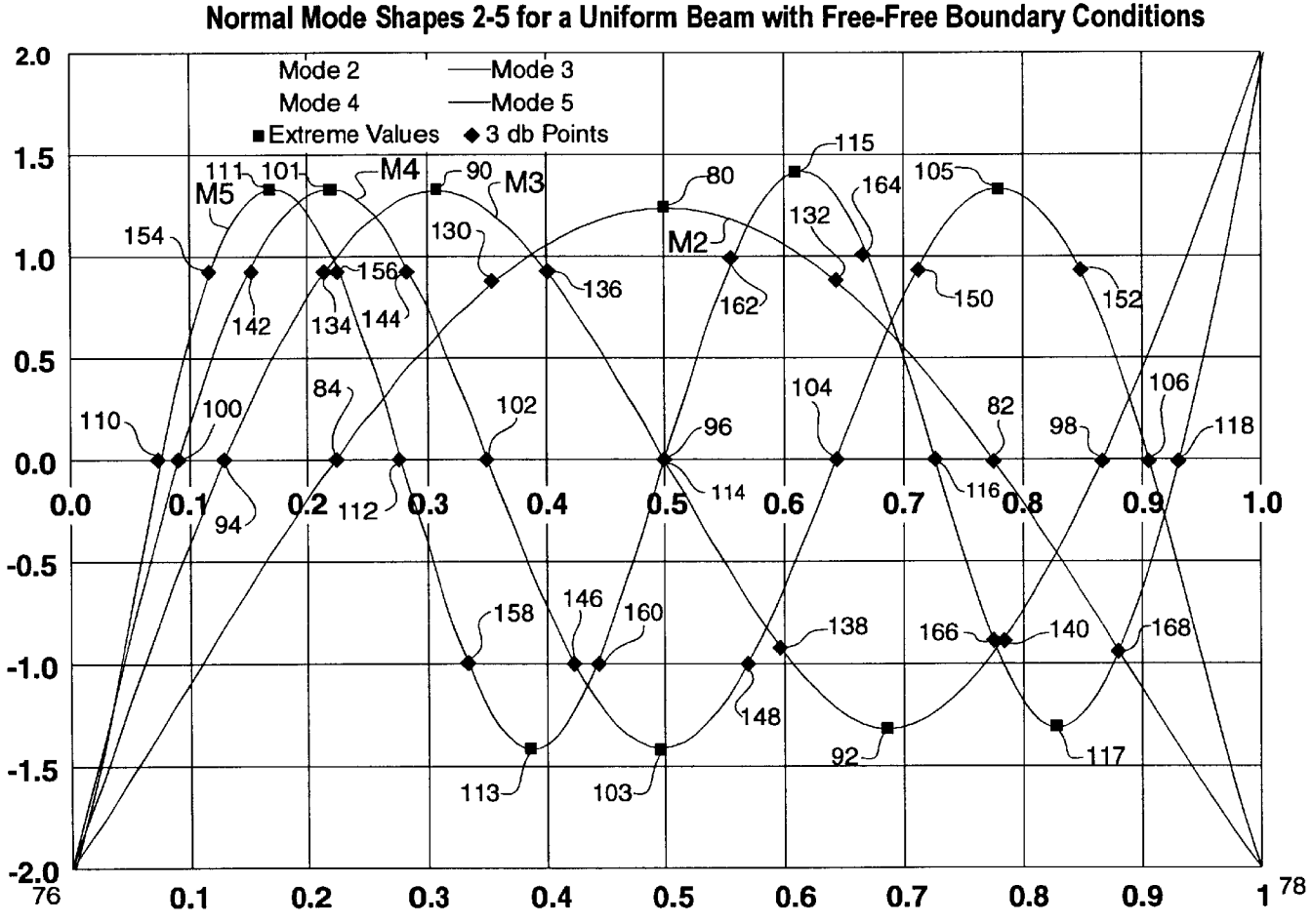
FIG. 3 is a plot of normal mode shapes for the second through fifth flexural vibration modes of a shaft with unconstrained ends.

Referring now to FIG. 3, which depicts the theoretical mode shapes of a uniform shaft of unit length having a butt end 76 and a tip end 78 that is unconstrained (free-free boundary conditions). As is well known in the art, each flexural vibration mode of a shaft has associated with it a characteristic shape; the first mode for free vibration of an unconstrained shaft being rigid body translation, the second mode being bending like a bow, the third mode being bending in the shape of an "s", etc. Each mode shape has associated with it at least one node, which is a point along the shaft that experiences no displacement and at least one antinode, which is a point along the shaft disposed between two nodes that experiences a local maximum vibration amplitude. For example the second mode M2 shown in FIG. 3 has the characteristic bow shape with one antinode 80 located between two nodes 82 and 84. Third mode M3 has the characteristic "s" shape with two antinodes 90 and 92, antinode 90 being disposed between nodes 94 and 96 and antinode 92 being disposed between nodes 96 and 98. Fourth mode. M4 similarly comprises a plurality of nodes 100, 102, 104, 106, and antinodes 101, 103, and 105 disposed therebetween. Fifth mode M5 similarly comprises a plurality of nodes 110, 112, 114, 116 and 118 and antinodes 111, 113, 115 and 117 disposed therebetween.

Associated with each antinode are two 3dB points, defined as the longitudinal position along the shaft nearest each antinode at which the shaft exhibits a vibration amplitude of 70.7% of the amplitude of that antinode. For example, associated with second mode antinode 80 are 3dB points 130 and 132. 3dB point 130 is disposed toward the butt end of the shaft and 3dB point 132 is disposed toward the tip end of the shaft relative to antinode 80. The amplitude of antinode 80 in FIG. 3 is approximately 1.25 units. 70.7% of 1.25 units is 0.88 units. The longitudinal positions along the shaft nearest antinode 80 at which the second mode shape M2 has an amplitude of 0.88 units are 0.36 and 0.64, respectively, which define the longitudinal positions of 3dB points 130 and 132, respectively, 3dB point 130 being 36% of the shaft length from the butt end ad 3dB point 132 being 64% of the shaft length from the butt end. Similarly each of antinodes 90, 92, 101, 103, 105, 111, 113, 115 and 117 have associated therewith a pair of 3dB points, 134, 136, 138, 140, 142, 144, 146, 148, 150, 152 154, 156, 158, 160, 162, 164, 166 and 168 as shown in FIG. 3.

Figure 4:
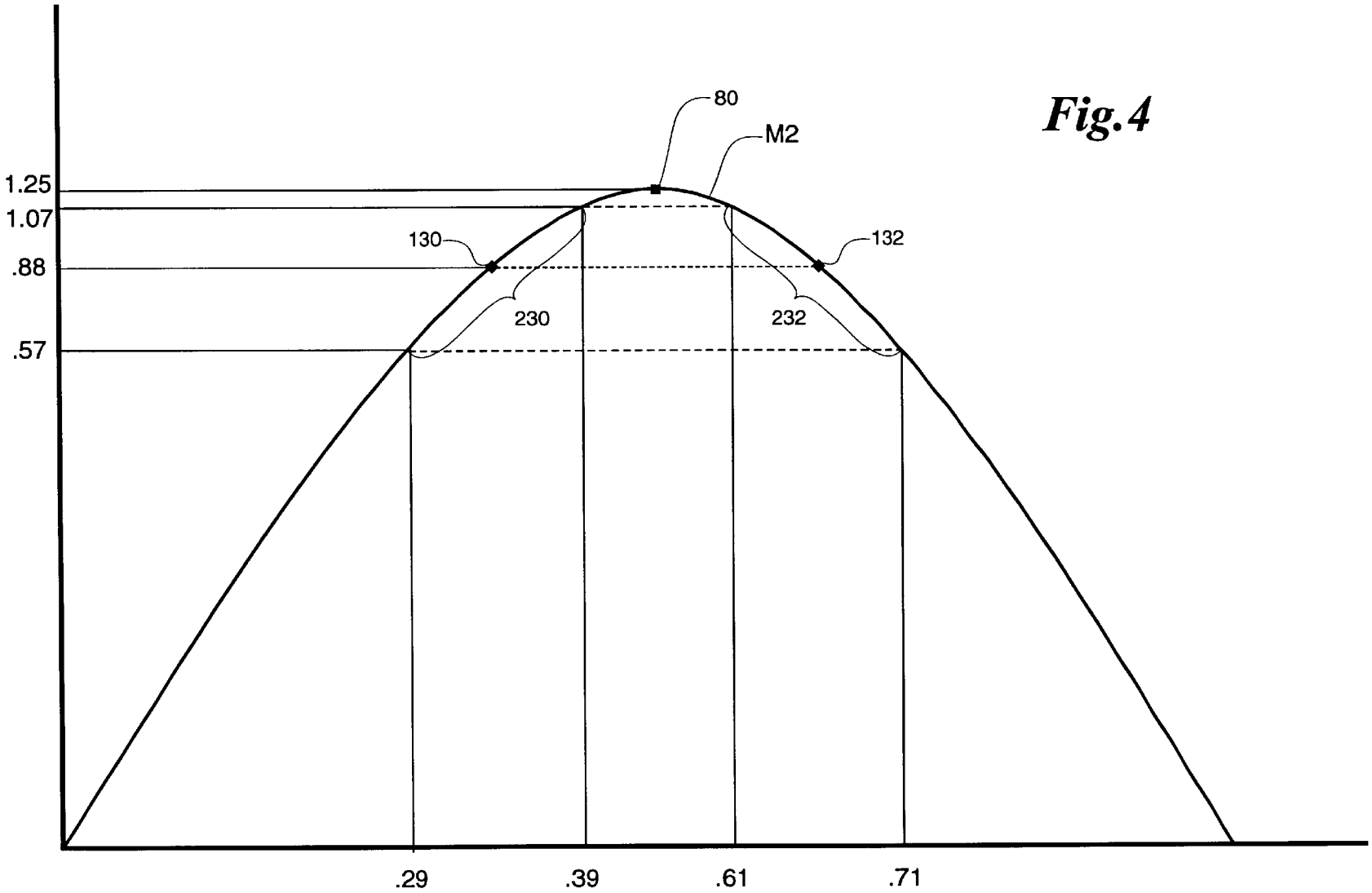
FIG. 4 is a plot of the second vibration mode of a shaft with unconstrained ends depicting the nodes, the antinode, and the 3dB points of the second mode.

FIG. 4 depicts second mode M2 by itself. Associated with 3dB points 130 and 132 are 3dB regions 230 and 232, respectively. 3dB regions 230 and 232 are defined as the longitudinal regions disposed about 3dB points 130 and 132 at which the shaft exhibits a vibration amplitude of 70.7% plus or minus 25% of the amplitude of antinode 80 (the antinode associated with 3dB points 130 and 132). Because the amplitude of 3dB points 130 and 132 are 70.7% of the amplitude of antinode 80, 3dB regions 230 and 232 alternatively may be expressed as the regions disposed about 3dB points 130 and 132 at which the shaft exhibits a vibration amplitude equal to 100% plus or minus 35.6% of the amplitude of 3dB points 130 and 132, respectively.

For example, antinode 80 has an amplitude of 1.25 units. As discussed above in connection with FIG. 3, 3dB points 130 and 132 each have an amplitude of 0.88 units or 70.7% of 1.25. 3dB regions 230 and 232 are defined as the regions having an amplitude of from 45.7% (70.7%−25%) to 85.7% (70.7%+25%) of 1.25, which is equal to from 0.57 units to 1.07 units. The longitudinal positions at which the second mode M2 exhibits a vibration amplitude of 0.57 units is approximately 0.29 units and 0.71 units. The longitudinal positions at which the second mode M2 exhibits a vibration amplitude of 1.07 units is approximately 0.39 units and 0.61 units. Thus 3dB region 230 corresponds to a longitudinal region of from 29% to 39% of the length of the shaft (measured from the butt end) and 3dB region 232 corresponds to a longitudinal region of from 61% to 71% of the length of the shaft (also measured from the butt end).

Figure 5:
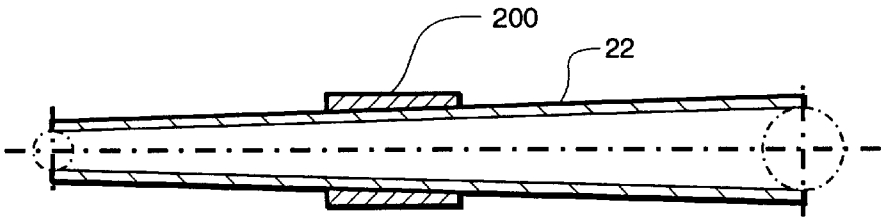
FIG. 5 is a cross section of a golf club shaft comprising a shaft stiffener in accordance with the present invention.
Figure 6:
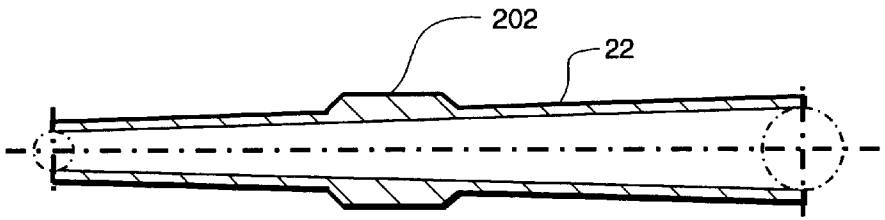
FIG. 6 is a cross section of a golf club shaft comprising an alternative shaft stiffener in accordance with the present invention.
Figure 7:
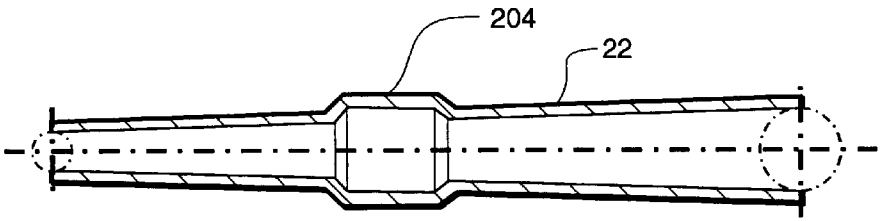
FIG. 7 is a cross section of a golf club shaft comprising yet another alternative shaft stiffener in accordance with the present invention.

The purpose of the frequency measurements and the determination of the 3dB points is to determine the optimum location for adding a plurality of discrete stiffeners to the shaft such that a node of at least the second flexural mode, preferably the second and third flexural mode, more preferably the second, third and fourth flexural modes, and most preferable the second, third, fourth, and fifth flexural modes occurs proximal the club face 30 and within the grip region 34 of shaft 22. As used herein, stiffeners refers to any means for providing a discontinuous increase in the section modulus of the shaft over a discrete distance. As shown in FIGS. 5, 6 and 7 the discrete stiffener may be a cylindrical collar such as solid cylindrical collar 200 or may be a metal or fiber mesh collar added to or imbedded in the base shaft, may be a locally thickened region 202, may be a discrete region 204 having an abrupt increase in diameter (both inner and outer) such that the wall thickness is constant but the section modulus of the region is increased over the section modulus of the immediately adjacent regions of the shaft 22, or may be any other conventional method of providing a discrete region having increased flexural stiffness. The flexural stiffness of the stiffeners should be such that the composite stiffness of the stiffened sections are at least 110% of the stiffness of the base shaft immediately adjacent the stiffeners. The stiffeners may be as long as necessary to couple the appropriate 3dB points, as discussed more fully below, but in any event should have a length to diameter ratio of at least unity, in order to effectively transfer the stiffness of the stiffener to the shaft.

Figure 8:
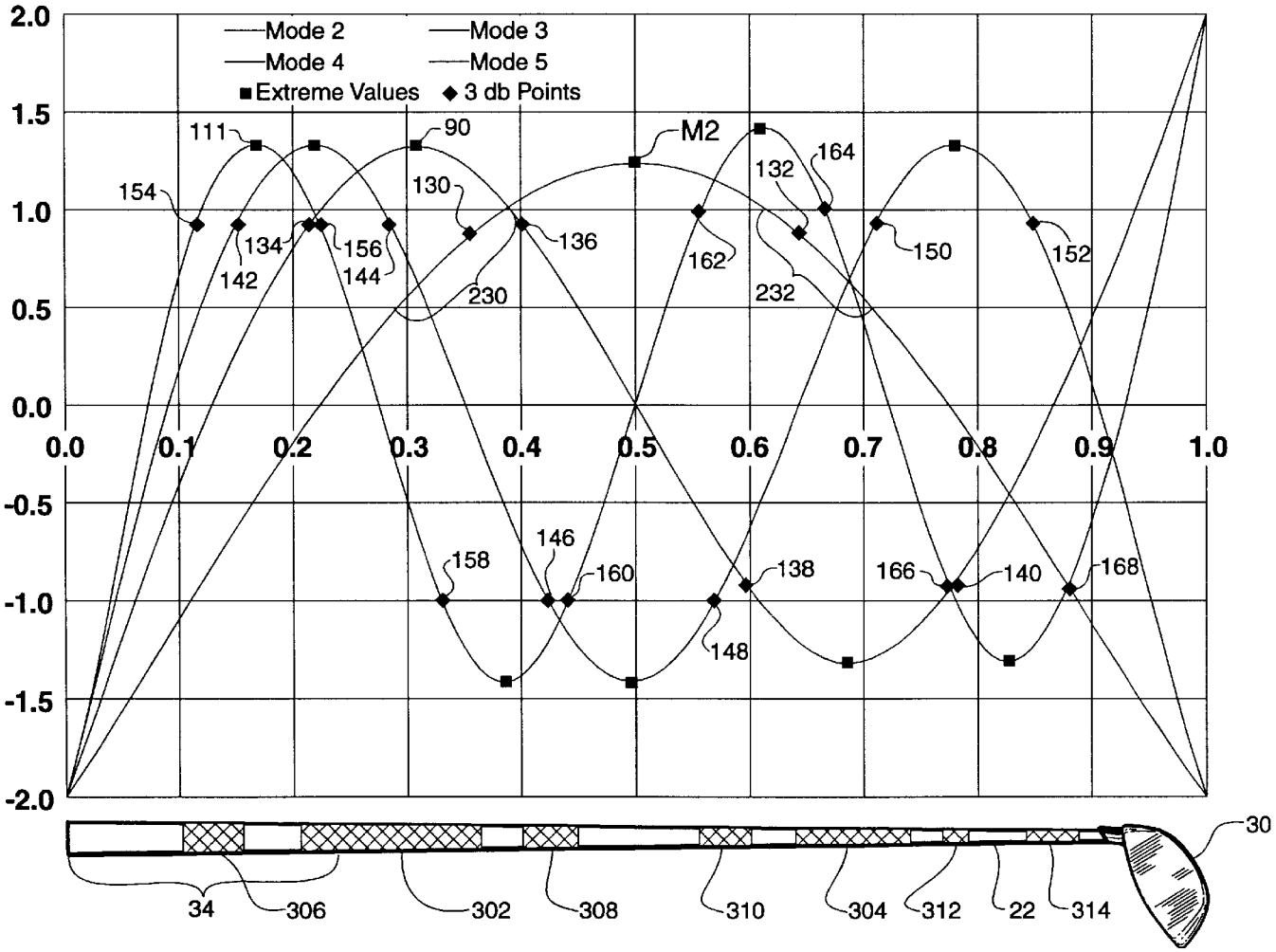
FIG. 8 is a plot of the normal mode shapes for the second through fifth flexural vibration modes of a golf club shaft with unconstrained ends together with a shaft comprising discrete stiffeners in accordance with the present invention.

As shown in FIG. 8, the location of the 3dB points determines the location of the stiffeners to be added to the shaft. Consistent with the foregoing, stiffeners are added to the shaft such that each stiffener is contiguous with one of 3dB regions 230 and 232 of the second mode and no single stiffener is contiguous with both 3dB points 130 and 132. For example, stiffener 302 is contiguous with 3dB region 230 and stiffener 304 is contiguous with 3dB region 232. Preferably stiffeners are selected so as to be contiguous with the 3dB regions associated with each of 3dB points 134, 136, 138, 140, 142, 144, 146, 148, 150, 152 154, 156, 158, 160, 162, 164, 166 and 168 so as to cause a node associated with each of the second, third, fourth and fifth modes to occur at the face 30 and within the grip region 34 of shaft 22. Thus stiffener 306 is contiguous with 3dB regions associated with 3dB points 154 and 142 but does not couple 3dB point 154 and 3dB point 156 through their associated antinode 111. Stiffener 302 couples 3dB points 134, 156, 144, 158 and 130, but does not couple 3dB point 134 to 3dB point 136 through their associated antinode 90. Stiffener 308 couples 3dB points 136, 146 and 160. Stiffener 310 couples 3dB points 162, 148 and 138. Stiffener 304 couples 3dB points 132, 164, and 150. Stiffener 312 couples 3dB points 140 and 166 and stiffener 314 couples 3dB points 152 and 168.

Figure 9:
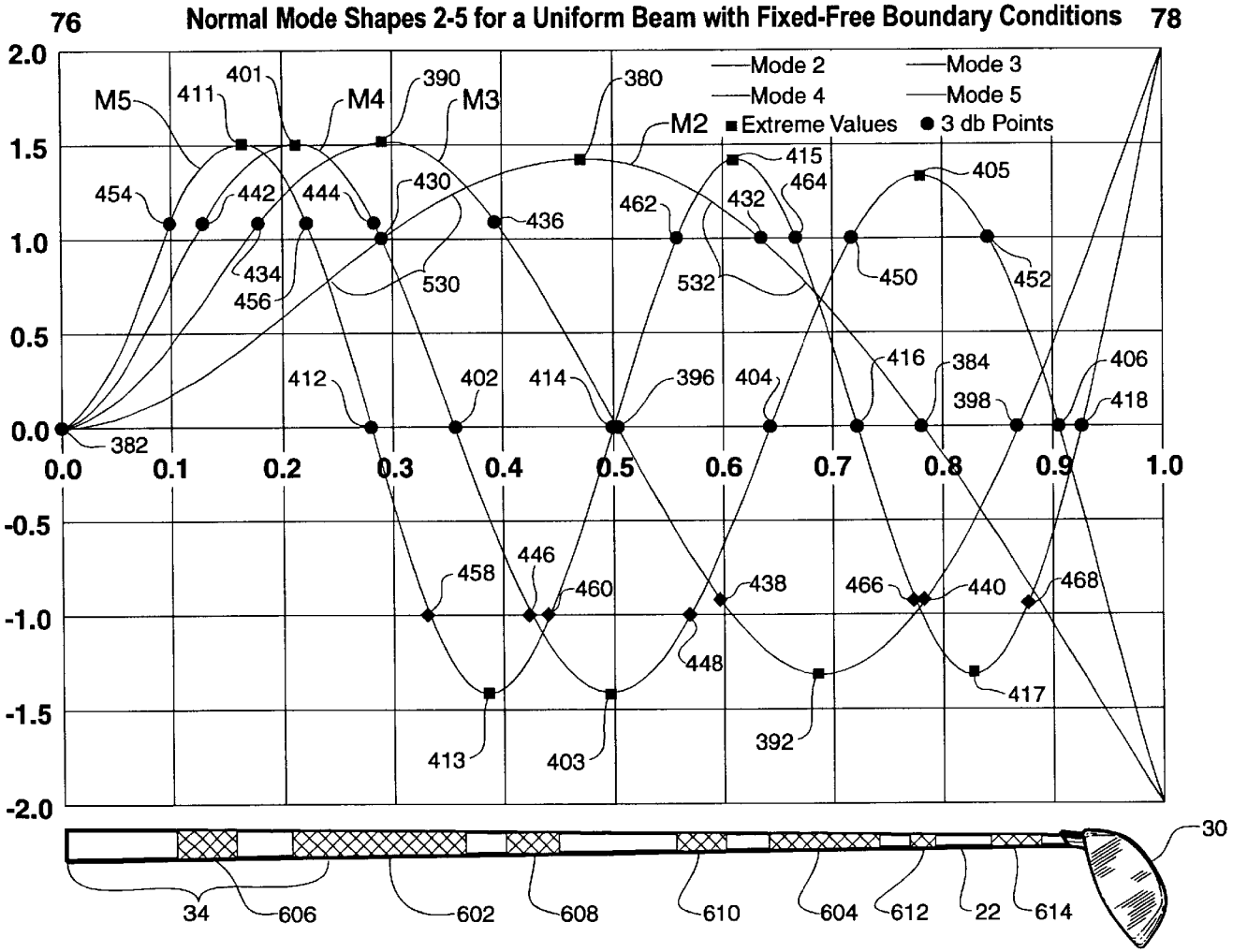
FIG. 9 is a plot of the normal mode shapes for the second through fifth flexural vibration modes of a golf club shaft with one constrained end together with a shaft comprising discrete stiffeners in accordance with the present invention.

FIG. 9 depicts the theoretical mode shapes of a uniform shaft of unit length having a fixed butt end 76 and a tip end 78 that is unconstrained (fixed-free boundary conditions). As with the free-free case discussed above, each flexural vibration mode of a fixed-free shaft has associated with it a characteristic shape; the first mode for fixed-free vibration being pure cantilever bending, the second mode being bending in the shape of an "s," the third mode being a triple bend "s"; etc. Each mode shape has associated with it at least one node, and at least one antinode. For example the second mode M2 shown in FIG. 9 has the characteristic "s" shape with one antinode 380 located between two nodes 382 and 384. Third mode M3 has the characteristic double-"s" shape with two antinodes 390 and 392, antinode 390 being disposed between nodes 382 and 396 and antinode 392 being disposed between nodes 396 and 398. The fixed boundary condition causes a node of each vibration mode to occur at the boundary. Accordingly, node 382 is common to modes M2 and M3 as well as the higher vibration modes. Fourth mode M4 similarly comprises a plurality of nodes 382, 402, 404, 406, and antinodes 401, 403, and 405 disposed therebetween. Fifth mode M5 similarly comprises a plurality of nodes 382, 412, 414, 416 and 418 and antinodes 411, 413, 415 and 417 disposed therebetween.

Associated with each antinode are two 3dB points. Associated with second mode antinode 380 are 3dB points 430 and 432. 3dB point 430 is disposed toward the butt end of the shaft and 3dB point 432 is disposed toward the tip end of the shaft relative to antinode 380. The amplitude of antinode 380 in FIG. 9 is approximately 1.4 units. 70.7% of 1.4 units is 0.99 units. The longitudinal positions along the shaft nearest antinode 380 at which the second mode shape M2 has an amplitude of 0.99 units are 0.29 and 0.63, respectively, which define the longitudinal positions of 3dB points 430 and 432, respectively, 3dB point 130 being 29% of the shaft length from the butt end ad 3dB point 132 being 63% of the shaft length from the butt end. Similarly each of antinodes 390, 392, 401, 403, 405, 411, 413, 415 and 417 have associated therewith a pair of 3dB points, 434, 436, 438, 440, 442, 444, 446, 448, 450, 452 454, 456, 458, 460, 462, 464, 466 and 468 as shown in FIG. 9. Associated with each 3dB point are 3dB regions which are the longitudinal regions disposed about each 3dB point at which the shaft exhibits a vibration amplitude of 70.7% plus or minus 25% of the amplitude of the corresponding antinode (100% plus or minus 35.6% of the amplitude of the 3dB point), as discussed in connection with FIG. 4 above.

Figure 10:
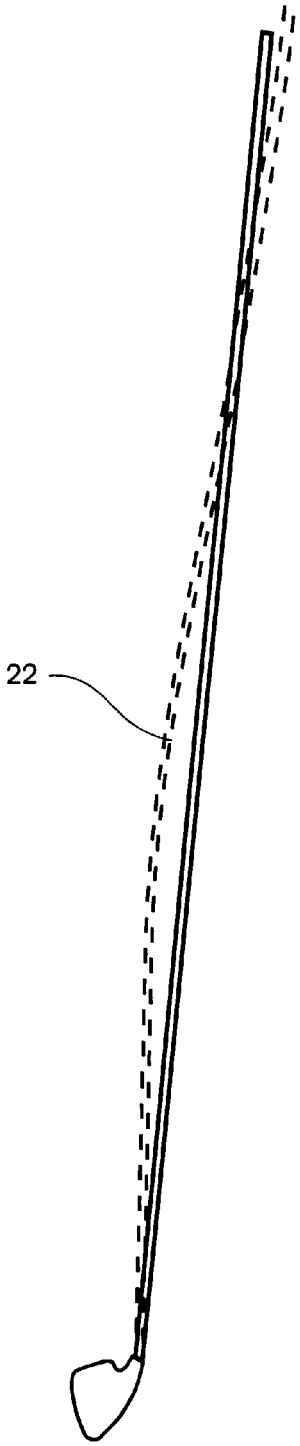
FIG. 10 is a plot of the second mode shape of an illustrative 5-iron animated by a finite element modal model.

As shown in FIG. 10, the 3dB regions are used to determine the optimum location for adding a plurality of discrete stiffeners to the shaft such that a node of at least the second mode, preferably the second and third mode, more preferably the second, third and fourth modes, and most preferable the second, third, fourth, and fifth modes occurs proximal the club head 28 and within the grip region 34 of shaft 22. Consistent with the foregoing, stiffeners are added to the shaft such that each stiffener is contiguous with one of the 3dB regions 530 and 532 of the second mode and no single stiffener is contiguous with both 3dB points 430 and 432. For example, stiffener 602 is contiguous with 3dB region 530 and stiffener 604 is contiguous with 3dB region 532 but neither is contiguous with antinode 380. Preferably, stiffeners are selected so as to be contiguous with the 3dB regions associated with each of 3dB points 434, 436, 438, 440, 442, 444, 446, 448, 450, 452 454, 456, 458, 460, 462, 464, 466 and 468 so as to cause a node associated with each of the second, third, fourth and fifth modes to occur proximal the head 28 and within the grip region 34 of shaft 22. Thus stiffener 606 is contiguous with 3dB regions associated with 3dB points 454 and 442 but does not couple 3dB point 454 and 3dB point 456 through their associated antinode 411. Stiffener 602 couples 3dB points 434, 456, 444, 458 and 430, but does not couple 3dB point 434 to 3dB point 436 through their associated antinode 390. Stiffener 608 couples 3dB points 436, 446 and 460. Stiffener 610 couples 3dB points 462, 448 and 438. Stiffener 604 couples 3dB points 432, 464, and 450. Stiffener 612 couples 3dB points 440 and 466 and stiffener 614 couples 3dB points 452 and 468.

Note that notwithstanding the difference between the boundary conditions of FIG. 8 and those of FIG. 9, the longitudinal positions of corresponding 3dB points for each mode of vibration, and therefore the predicted positions of the discrete stiffeners are substantially the same. Given that the human golfer is neither a perfect free-free boundary condition nor a perfect fixed-free boundary condition, the actual locations of the stiffeners will be somewhere between the theoretical free-free and fixed-free locations.

Additionally, since a golf club is not a uniform beam, but is typically tapered, may have built-in discontinuities and has a mass at one end associated with the golf club head, neither the fixed-free nor the free-free theoretical mode shapes will perfectly predict the proper location of the discrete stiffeners. These complexities cause the theoretical bending equations to become extraordinarily complex and difficult to solve. Accordingly, in order to design a real life golf club having suppressed vibration modes according to the present invention finite element modal analysis software is used in conjunction with the actual frequency response measurements discussed in connection with FIG. 1 to predict the actual free-free modal shape of a particular shaft. As discussed in connection with FIG. 1, accelerometer 50 is located such that the axis of the accelerometer is substantially orthogonal to the axis of the shaft and the plane of face 30. Preferably, the impact response is measured five times at each location along the shaft and the data averaged using the spectrum analyzer 54. The averaged data is then, stored in a memory file for later inputting into the modal model. Once the data is collected at each location along the shaft and averaged using spectrum analyzer 54, the files containing the averaged data are inputted into a finite element modal model, such as the ME-SCOPE software program distributed by Vibrant Technology, Inc. Each set of averaged data is assigned to a corresponding test point in the modal model and the software run to determine the dominant frequencies and mode shapes of the dominant frequencies of the actual shaft.

As shown in FIG. 10, once the software has generated the stiffness matrix and performed the appropriate calculations, the modal model software is capable of animating the stick model in order to graphically represent the mode shapes of the vibrating shaft. Animating the mode shapes assists the user in determining the locations of nodes, antinodes, and 3dB points associated with each mode shape. For example, the second mode of the 5-iron shown in FIG. 10 occurs at 40 Hz has a first node within the grip region located 6 inches from the butt end of the shaft, a second node proximal the club head located 37 inches from the butt end, and an antinode located 25 inches from the butt end of the shaft. The displacement of the antinode is 874 inches, therefore, the displacement of the 3dB points will be 618 inches. The axial locations at which this displacement occurs is approximately 16 inches from the butt end of the shaft and approximately 34 inches from the butt end of the shaft.

Figure 11:
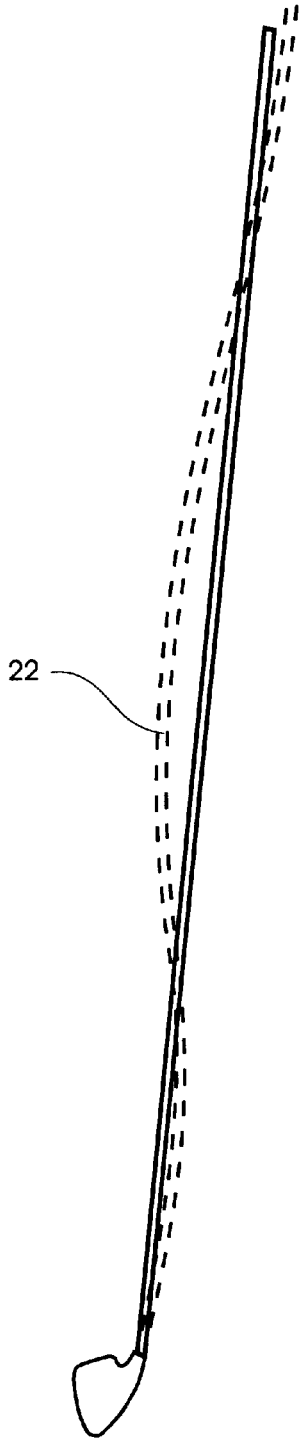
FIG. 11 is a plot of the third mode shape of the illustrative 5-iron of FIG. 10.

As shown in FIG. 11, the third mode of the illustrative 5-iron occurs at 116 Hz, has a first node located within the grip region 4 inches from the butt end of the shaft, a second intermediate node located 24 inches from the butt end, and a third node proximal the club head located 37 inches from the butt end of the shaft. The first antinode is located 13 inches from the butt end and the second antinode is located 33 inches from the butt end of the shaft. As with the second mode illustrated in FIG. 10, the 3dB points associated with each of the antinodes of the third mode are determined based on the axial location on either side of the antinode at which 70.7% of the displacement of that antinode occurs.

The locations of the 3dB points for each of the dominant of the second through fifth modes are determined as described above and each 3dB point designated in the model thus providing a composite model having a plurality of 3dB points. Simulated stiffeners are added to the model such that no single stiffener is more than 6 inches long and each of the stiffeners is contiguous with at least one of the 3dB points, but no one simulated stiffener is contiguous with both 3dB points associated with any one antinode. Once the simulated stiffeners are added to the modal model, the software is run to verify that nodes associated with at least the second and third modes, preferable the second, through fourth modes, and most preferably the second through fifth modes occur both on the face of the club and within the grip region. Of course, slight adjustments to the length and/or position of the stiffeners, for example to accommodate the boundary conditions imposed by the grip of the human user, can be made using the modal software in order to optimize the design based on the criteria stated above. Similarly, field adjustments based on the human user's actual swing are also contemplated within the scope of the present invention.

Because the boundary conditions imposed by the human user's swing are neither perfectly fixed nor perfectly free, but instead comprise a complex coupling between the shaft and the user, it is possible that the vibration modes of the shaft will differ from those predicted by the modal software. Accordingly, it would be advantageous to permit the stiffening collars to be relocated to accommodate the flexural modes induced by a particular user. In effect, this amounts to tuning the golf club shaft to the individual. Adhesively bonded, pressed on, or conventional shrink-fitted collars would be difficult to remove and relocate in the field. Accordingly, a plurality of shape memory alloy collars would be particularly suited to providing a field adjustable damp shaft.

As used herein, a shape memory alloy means a material that has the capability of once having been deformed from an original, heat-stable configuration to a different configuration, it will remain in the deformed condition until raised above a certain temperature when it will return, or attempt return to its original heat-stable configuration. As used herein, this recoverable deformation is referred to as "thermally-recoverable plastic deformation." Typically the shape memory alloy is heat-stable in its austenitic phase and heat unstable in its martensitic phase. Examples of metallic materials that are capable of having the property of shape memory include gold cadmium and silver gold cadmium alloys such as described in U.S. Pat. No. 3,012,882 as well as nickel titanium alloys such as described in U.S. Pat. No. 4,035,007.

It is well-known that metallic materials have an elastic limit, that is, they can be deformed up to a certain point and when the deforming force is removed they will return to their original shape. If a normal metallic material is exposed to a deforming force great enough to exceed its elastic limit, some permanent deformation will take place. This deformation will be referred to herein as "non-thermally recoverable plastic deformation." It is also possible to induce non-thermally recoverable plastic deformation in materials exhibiting shape memory. For example, a force can be imposed on the material that exceeds the limit for imparting the maximum thermally recoverable plastic deformation to the shape memory alloy while it is maintained below its transition temperature and in the martensitic phase. Alternatively, the shape memory alloy can be worked in the austenitic phase, above the transition temperature so that only non-thermally recoverable plastic deformation takes place. In either case, the non-thermally recoverable plastic deformation sets up internal stresses in the material. When a shape memory alloy is passed downwardly through its transition temperature these stresses are relieved and there will be a resulting change of shape of the material. The shape change at the transition temperature is referred to herein as "spontaneous expansion."

The shape memory and spontaneous expansion properties of shape memory alloys permit a simple collar formed of a shape memory alloy may be expanded radially at a temperature below the transition temperature of the material, for example, by forcing the collar over a mandrel having a diameter greater than the original internal diameter of the collar. The degree of expansion preferably is great enough so that both thermally recoverable and non-thermally recoverable plastic deformation takes place. The collar is then raised above the transition temperature while being maintained at the expanded position by the mandrel. As the collar recovers its austenitic phase, it will squeeze tightly on the mandrel as it attempts to heat recover to its original configuration.

At the appropriate time, the collar is again cooled to below its transition temperature. When the collar reaches the transition temperature, spontaneous expansion occurs, increasing the internal diameter of the collar, resulting in the collar being easily removable from the mandrel. As long as the temperature of the collar is kept below the transition temperature, it will retain its internal diameter, enabling the collar to be placed in position over the appropriate location on the golf club shaft. After the collar has been installed on the shaft, the collar is allowed to warm to above the transition temperature. As the collar warms, it recovers or shrinks towards its heat-stable configuration until it tightly grips the exterior of the shaft and is restrained from further recovery. Since the recovery forces are substantial, the collar makes an extremely tight fit on the shaft so long as the collar is maintained above the transition temperature. The restraining action of the shaft on the collar re-introduces non-thermally recoverable plastic deformation stresses in the material of the collar. Consequently, when the collar is again cooled to its transition temperature, these stresses will be relieved in the form of spontaneous expansion, and the collar may again be removed and relocated along the shaft.

Ideally, for use as a stiffener to selectively damp vibrations of a golf club shaft, the material out of which the collar is made will exhibit a transition temperature lower than the lowest temperature at which a golf club shaft would likely be used. Since none but the most avid golfer would golf when the temperatures were more than 50 degrees below zero Celsius, , a broad category of nickel titanium iron and nickel titanium manganese alloys are suitable. These alloys exhibit a transition temperature of from minus 50° C. to minus 196° C. It is contemplated that preformed collars made of these shape memory alloys would be stored below the transition temperature and installed as needed on a shaft, where they would be permitted to warm to room temperature, which would be substantially above the transition temperature of the material. Once in place, the collars could be relocated at will simply by chilling them to below the transition temperature where spontaneous expansion would cause the collars to loosen from the shaft. Since conventional metallic materials shrink when cooled, chilling an assembly comprising a conventional steel shaft with a plurality of shape memory alloy collars as hereinbefore described would be a convenient way of loosening the collars for relocation. Alternatively, chilling individual collars, for example by passing a liquid or gaseous coolant directly over the collar (e.g. liquid or gaseous nitrogen) would also be a suitable method of expanding the shape memory alloy collars.

Although certain preferred embodiments and methods have been disclosed herein, it will be apparent from the foregoing disclosure to those skilled in the art that variations and modifications of such embodiments and methods may be made without departing from the spirit and scope of the invention. Accordingly, it is intended that the invention shall be limited only to the extent required by the appended claims and the rules and principles of applicable law.

What is claimed is:

1. A golf club comprising:

a golf club head;

a shaft;

a grip; and a plurality of stiffeners;

said shaft comprising a composite shaft having a tip end and a butt end, said golf club head being attached to said tip end of said shaft, said grip being attached to a region of said shaft extending from said butt end of said shaft toward said tip end, said grip defining a grip legion of said shaft, said shaft comprising a substantially hollow conical frustum having an inside surface widening progressively from a minimum diameter proximal the tip end to a maximum diameter proximal the butt end and an outside surface widening progressively from a minimum diameter proximal the tip end to a maximum diameter proximal the butt end, said inside surface and said outside surface defining a shaft wall of predetermined thickness; and each of said plurality of stiffeners comprising a discrete substantially axisymmetric locally thickened region having a thickness greater than said shaft wall immediately adjacent said stiffener, said plurality of locations chosen such that said stiffeners cause a node of each of said second and third flexural vibration modes of said shaft to occur proximal said golf club head and a node of each of said second and third flexural vibration modes of said shaft to occur proximal said grip region, wherein:

said plurality of stiffeners includes a first pair of stiffeners, one of said first pair of stiffeners comprising a locally thickened region longitudinally centered about a first location proximal the tip end of said shaft relative to a first antinode of said second vibrational mode, the other of said first pair of stiffeners comprising a locally thickened region longitudinally centered about a second location proximal the butt end of said shaft relative to said first antinode, said first and second locations being defined as the longitudinal positions nearest said first antinode at which 70.7% plus or minus 25% of the deflection of said first antinode occurs.

2. The golf club of claim 1, wherein:

said first and second locations are defined as the longitudinal positions nearest said first antinode at which 70.7% plus or minus 10% of the deflection of said first antinode occurs.

3. The golf club of claim 1, further comprising a second pair of stiffeners, one of said second pair of stiffeners comprising a locally thickened region longitudinally centered about a third location proximal the tip end of said shaft relative to a second antinode, the other of said second pair of stiffeners comprising a locally thickened region longitudinally centered about a fourth location proximal the butt end of said shaft relative to said second antinode, said second antinode comprising an antinode of said third vibrational mode of said shaft, said third and fourth locations being defined as the longitudinal positions nearest said second antinode al which 70.7% plus or minus 25% of the deflection of said second antinode occurs.

4. The golf club of claim 3, wherein:

said third and fourth locations are defined as the longitudinal positions nearest said second antinode at which 70.7% plus or minus 10% of the deflection of said second antinode occurs.

5. The golf club of claim 4, wherein:

said stiffeners comprise a locally thickened region having an external diameter greater than a diameter of said shaft immediately adjacent said locally thickened region, said stiffener comprising a cross-sectional stiffness at least 110% of the cross sectional stiffness of said shaft immediately adjacent said stiffener.

6. The golf club of claim 5, wherein:

said stiffeners comprise a locally thickened region having an internal diameter smaller than a diameter of said shaft immediately adjacent said locally thickened region, said stiffener comprising a cross-sectional stiffness at least 110% of the cross sectional stiffness of said shaft immediately adjacent said stiffener.

7. A golf club comprising:

a golf club head;

a shaft;

a grip; and a plurality of stiffeners;

said shaft comprising a composite shaft having a tip end and a butt end, said golf club head being attached to said tip end of said shaft, said grip being attached to a region of said shaft extending from said butt end of said shaft toward said tip end, said grip defining a grip region of said shaft, said shaft comprising a substantially hollow conical frustum having an inside surface widening progressively from a minimum diameter proximal the tip end to a maximum diameter proximal the butt end and an outside surface widening progressively from a minimum diameter proximal the tip end to a maximum diameter proximal the butt end, said inside surface and said outside surface defining a shaft wall of predetermined thickness; and each of said plurality of stiffeners comprising a discrete substantially axisymmetric locally thickened region having a thickness greater than said shaft wall immediately adjacent said stiffener, said plurality of locations chosen such that said stiffeners cause a node of each of said second and third flexural vibration modes of said shaft to occur proximal said golf club head and a node of each of said second and third flexural vibration modes of said shaft to occur proximal said grip region, wherein:

said shaft has at least a second and a third flexural vibration mode;

said second and third flexural vibration modes define a plurality of antinodes and a pair of 3dB points associated with each of said plurality of antinodes, each of said pair of 3dB points comprising a first 3dB point disposed toward tip end of said shaft relative to one of said plurality of antinodes and a second 3dB point occurring toward the butt end of said shaft relative to said antinode, said first and second 3dB points each comprising a longitudinal position along said shaft nearest said antinode at which 70.7% of the deflection of said antinode occurs, each of said 3dB points defining a corresponding 3dB region, each of said 3dB regions comprising a longitudinal region along said shaft contiguous with said 3dB point at which 100% plus or minus 35.6% of the deflection of said 3dB point occurs;

said plurality of stiffeners being attached to said shaft such that each of said stiffeners is contiguous with at least one of said 3dB regions and no one of said plurality of stiffeners is contiguous with both 3dB points of any of said pairs of 3dB points.

8. The golf club of claim 7, wherein said plurality of stiffeners are attached to said shaft such that each of said stiffeners is contiguous with at least one of said 3dB points.

* * * * *